United States Patent [19]

Diesner

[11] 4,039,008

[45] Aug. 2, 1977

[54] METHOD OF AND A MACHINE FOR MANUFACTURING AT LEAST ONE NAP FABRIC STRIP

[75] Inventor: Ferdinand Diesner, Murg-Hanner, Germany

[73] Assignee: Patax Trust Reg., Liechtenstein

[21] Appl. No.: 626,274

[22] Filed: Oct. 28, 1975

[30] Foreign Application Priority Data

| | | |
|---|---|---|
| Oct. 29, 1974 | Switzerland | 14503/74 |
| Oct. 29, 1974 | Switzerland | 14504/74 |
| Sept. 3, 1975 | Switzerland | 11397/75 |

[51] Int. Cl.[2] ..... D03D 39/16; D03D 39/00

[52] U.S. Cl. ..... 139/21; 139/39; 139/291 C

[58] Field of Search ..... 139/20, 21, 22, 37, 139/38, 39, 40, 41, 291 C

[56] References Cited

U.S. PATENT DOCUMENTS

| | | | |
|---|---|---|---|
| 14,285 | 2/1956 | Johnson | 139/42 |
| 2,768,649 | 10/1956 | Bistany | 139/40 |

FOREIGN PATENT DOCUMENTS

| | | | |
|---|---|---|---|
| 193,175 | 11/1889 | France | 139/42 |
| 58,871 | 1/1891 | Germany | 139/39 |

*Primary Examiner*—Henry S. Jaudon
*Attorney, Agent, or Firm*—McGlew and Tuttle

[57] ABSTRACT

In the method, at least one nap fabric strip is woven in a shuttle-less strip loom from weft and warp threads. A first shed is formed from a first layer of warp threads and from a second layer of warp threads. A second shed is formed from the second layer of warp threads and from a third layer of warp threads. A weft thread is introduced into the first shed. A free end portion of an elongate resiliently or elastically deformable element is introduced into the second shed. The elongate element is displaced towards the edge of the fabric strip such that an intermediate portion of the elongate resiliently or elastically deformable element external of the second shed is deformed with portions of the third warp threads wrapped around the elongate resiliently or elastically deformed element to form the nap loops. The elongate element is secured in the deformed position at least until the beating up of the next weft thread and then the elongate element is withdrawn from the second shed whereby, in consequence of its resilient deformability, the elongate element returns to its initial undeformed shape. Apparatus for carrying out the method is also disclosed.

12 Claims, 14 Drawing Figures

METHOD OF AND A MACHINE FOR MANUFACTURING AT LEAST ONE NAP FABRIC STRIP

BACKGROUND OF THE INVENTION

The present invention relates to a method for the manufacture of at least one nap fabric tape, provided with a base fabric and with nap elements, by a shuttle-less powered strip loom.

Nap fabric tapes are employed particularly for tape fasteners with two tapes, which each, on one tape side, display coupling means arranged areally. The nap piles forming the coupling means can then perhaps be loop-shaped in the case of one tape and hook-shaped or mushroom-shaped in the case of the other tape.

In a known method for the manufacture of nap fabrics by needle looms, a first shed is formed by basic warp threads and a second by pile warp threads. The weft thread is then introduced each time into the first shed and tied. Each time when nap loops are to be formed, a substantially rigid rod, which in the language of the art is designated as a needle or rod, is introduced in weft direction into the second shed and subsequently displaced in the direction of the warp up to the reed abutment location. The rod then remains in this position at least up to the introduction of the next weft and is thereafter again withdrawn laterally and finally moved back along the warp threads into the initial position. The rod must thus execute a movement with several changes of direction. Due to the acceleration forces arising in the course of this relatively complicated movement, the maximum possible weaving speed is limited to a relatively low value in this prior known method.

A known machine for the performance of this method has two rails displaceable parallel to the weft threads. A rectilinear guide, extending parallel to the warp threads, is fastened to each of these rails. Displaceably guided in each rectilinear guide is a rod, the forward end of which is angled and forms a needle extending parallel to the weft threads. A drive device is further present to push the two rails to and fro separately in their longitudinal direction, i.e. parallel to the weft threads. The machine furthermore includes a drive device with a pusher displaceable parallel to the warp threads. This is so arranged that it can engage the two displaceable rods and push these away against the transport direction of the fabric.

It is now to be assumed that one of the two needles is woven into the fabric and the other is disposed outside the fabric. The latter needle is now first pushed parallel to the warp threads in front of the shed by means of the pusher and then pushed into the shed by displacement of the rails, on which its guide is fastened. Subsequently, the newly pushed-in needle is transported to the reed abutment location by the reed together with the newly introduced weft thread. The pile warp threads running around the needle then form loops. During the next weft insertion, the needle already previously introduced into the fabric is again withdrawn from the fabric by displacement of the respective rail and can then be pushed in front of the shed by means of the pusher. In this manner, the two needles can be pushed alternately into a shed, be transported by the reed to the reed abutment location and then again be withdrawn from the fabric and pushed in front of a new shed. As described, these movements are generated by pushing the rails to and fro and by pushing the needles by means of the pusher. Each needle is thus moved by two different drive members, namely the rail and the pusher. The prior known method and the machine for the performance thereof are therefore relatively complicated and make possible only relatively low weaving speeds as already explained. The latter is the case especially also for the reason that the pusher is not permanently connected with the needles and produces an impact each time it pushes a needle away.

A further method and a further machine for the performance thereof are known from the book "Webmaschinen", which was written under the editorship of H. Hahn and published in 1966 by VEB Fachbuchverlag Leipzig. The machine described in this book includes several rods, which serve for the formation of nap loops and which are designated as rods, however likewise these are essentially rigid rods. Each rod is provided at its rearward end with a platelet, which has a four-sided hole and a slot. The machine includes a rod rail, which serves to guide the rods and which, at its end further removed from the fabric, is pivotably connected with the machine frame by means of a spigot perpendicular to the fabric. The rod rail can be pivoted to and fro by means of a rod rail drive device, so that it extends either parallel to the weft threads or somewhat oblique to these. Further present is a rod carriage, which is guided to be displaceable parallel to the weft threads and can be displaced to and fro by means of a rod carriage drive device.

It is now assumed that one of the rods is disposed in the rod rail and that the remaining rods are introduced into the fabric. The rod rail is now pivoted by means of the rod rail drive device in such a manner, into a position oblique to the weft threads, that the forward rod end gets in front of the shed. The rod carriage is now displaced by means of the rod carriage drive device towards the fabric, while it engages in the slot in the platelet at the rearward rod end and pushes the rod into the shed. When the rod has been entirely pushed into the shed, it gets completely out of the rod rail. The latter is thereupon pivoted back into a position parallel to the weft threads. The rod carriage now seizes the rod disposed in the fabric for the longest time and withdraws this from the fabric into the rod rail. With this, the cycle can again begin from the start.

Also in this prior known method, the rod must thus on the one hand be displaced by means of a drive device along its guide, i.e. along the rod rail, and the rod rail must on the other hand be moved by means of another drive device. The rods, when they are introduced into the shed and are further transported by the fabric, must furthermore in this prior known method be completely separated from the two drive devices and must then again be seized by means of the rod carriage. Only relatively low weaving speeds are therefore possible also with this prior known method.

SUMMARY OF THE INVENTION

According to one aspect of the present invention there is provided a method of weaving at least one nap fabric strip in a shuttle-less strip loom, the method comprising the steps of forming a first shed from a first layer of warp threads and from a second layer of warp threads, forming a second shed from said second layer of warp threads and from a third layer of warp threads, introducing a weft thread into the first shed, introducing a free end portion of an elongate resiliently or elastically deformable element into the second shed, displacing an elongate element towards the rear edge of the fabric strip such that an intermediate portion of the elongate resiliently or elastically deformable element external of the second shed is deformed with portions of the third warp threads partially surrounding the elongate element to form nap loops, securing the elongate element in the deformed position at least until the beating up of the next weft thread, and then withdrawing the elongate flexible element from the second shed, whereby in consequence of its resilient deformability the elongate element returns to its initial undeformed shape.

According to another aspect of the present invention there is provided a shuttle-less loom for manufacturing at least one nap fabric strip provided with a base fabric and with a plurality of nap loops, the loom comprising, in combination a frame, a shed forming device adapted to divide warp threads of at least one strip into three mutually spaced layers of warp threads, thereby to form a first shed from first and second ones of the layers and to form a second shed from the second and a third ones of the layers, means to introduce a weft thread into the first shed, guide means, a resiliently or elastically deformable elongate rod member mounted to be reciprocatably displaceable along the guide means, drive means to displace the flexible elongate rod member along the guide means thereby to introduce a free end portion of the resiliently or elastically deformable elongate rod member into the second shed, means to displace the elongate rod member towards the rear edge of the strip in such a manner that an intermediate portion of the elongate rod member external of the second shed is resiliently deformed with portions of the warp threads of the second layer partially surrounding the elongate rod member to form the nap loops, means to secure the elongate rod member in the deformed position at least until the beating up of the next weft thread, and means to withdraw the elongate rod member from the second shed, whereby in consequence of its resilient or elastic deformability the elongate rod member returns to its initial undeformed shape.

According to a further aspect of the present invention there is provided a nap fabric strip comprising a plurality of closed nap loops and a plurality of knubs each provided with a deformed free end portion.

BRIEF DESCRIPTION OF THE DRAWINGS

Embodiments of the invention will now be more particularly described by way of example with reference to the accompanying drawings, in which.

DESCRIPTION OF THE PREFERRED EMBODIMENTS

Figure 1:
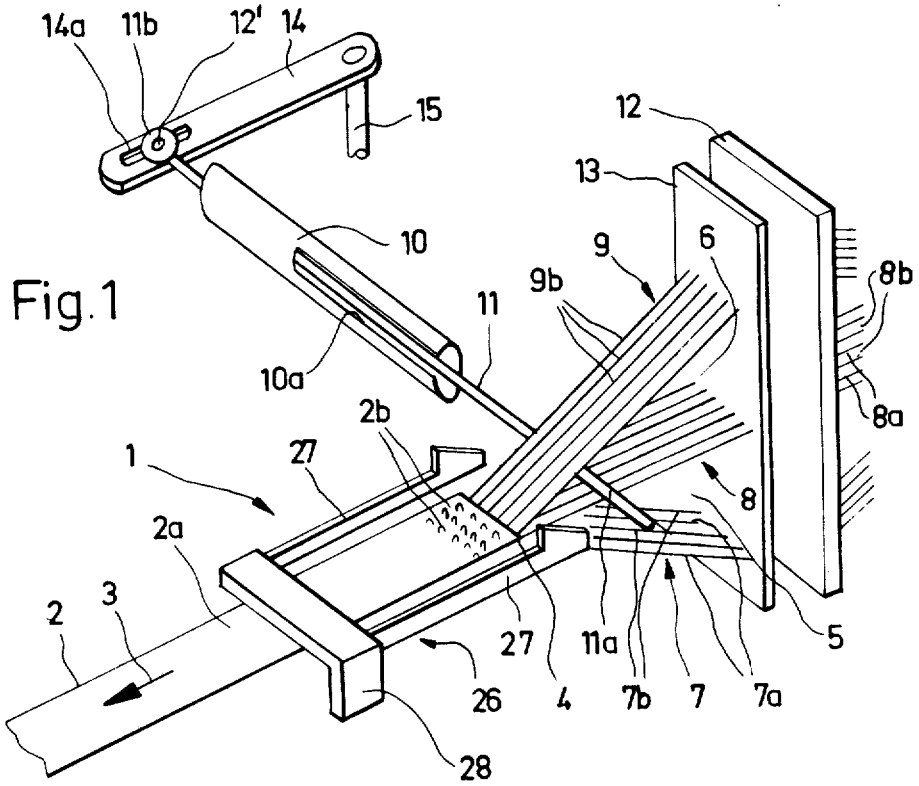
FIG. 1 shows a power tape loom with a resiliently or elastically deformable rod at the instant at which the latter is introduced into the shed.
Figure 2:
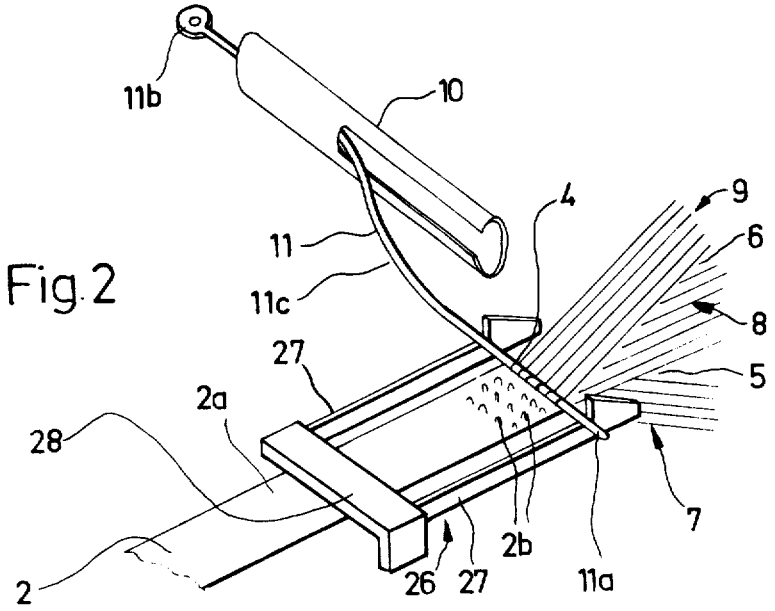
FIG. 2 shows a few elements of the power tape loom illustrated in FIG. 1 at the instant at which the free rod end is disposed at the reed abutment location.

Referring now to the accompanying drawings, a shuttle-less power strip loom, which is indicated generally by the reference numeral 1 for manufacturing nap fabrics, is shown in FIGS. 1 and 2. The produced fabric strip 2 is guided through a tape holder (not shown) and during the weaving moves in the direction indicated by the arrow 3.

At the start of a new weaving cycle, the warp threads are divided up, at the edge of the fabric strip adjacent a reed abutment location 4, into three warp thread layers 7, 8 and 9 by a shed forming device 12, which comprises a plurality of shafts or Jacquard pulls. A first or lower layer 7 and a middle or second layer 8 together form a first shed 5. The second layer 8 and an uppermost or third layer 9 together form the second shed 6. The lowermost layer 7 contains two kinds of warp threads, namely tautly tensioned basic warp threads **7*a* and loose or only slightly tensioned pile warp threads 7*b*. The middle layer 8 is likewise formed by basic warp threads 8*a* and pile warp threads 8*b*. The uppermost layer 9 by contrast contains only pile warp threads 9*b***.

The basic warp threads **7*a* and 8*a* serve, together with the not shown weft thread, for the formation of the basic fabric 2*a* of the tape 2**. The weft thread is inserted after each change of shed by a weft thread insertion member.

The power strip or tape loom includes a sleeve 10. This is so mounted on a machine frame (not shown) of the loom that the longitudinal axis of the sleeve 10 extends approximately perpendicularly to the strip or tape 2 and is directed towards the second shed 6. The sleeve section facing the latter is provided with a longitudinal slot **10*a* on its side remote from the shed forming device 12. An elongate deformable element in the form of a resilient rod 11 is displaceably guided in the sleeve 10. The sleeve 10 thus forms a guide means in the form of a rectilinear guide tube for the rod 11. The forward free end section 11*a* of the rod 11 penetrates the second shed 6 at the instant in time illustrated in FIG. 1. The rearward end of the rod 11 is provided with a thickened portion 11*b* and connected with a pin 12'. The latter extends into the slot 14*a* of a drive member in the form of a pivot arm 14, which is secured to a shaft 15 and which, in operation, executes to and fro pivotal motions and serves as a drive member for the rod 11. The rod 11 is thus positively coupled to the drive member by being shape-lockingly connected with the pivot arm 14**.

The power strip or tape loom 1 also includes gripper means indicated generally at 26 and fastened to the machine frame (not shown). The gripper means is provided with a carrier 28 and with two hooks 27 fastened in rake-like manner to the carrier 28. The two hooks 27 of the gripper 26 extend parallel to the middle warp thread layer 8. The two hooks 27 are arranged adjacent the tap edges and slightly above the finished tape 2 and the middle warp thread layer 8.

A reed 13 is so constructed that it can be moved through and between the free ends of the two hooks 27 up to the reed abutment location 4.

When a series of nap loops are to be formed, the rod 11 is, on the insertion of the weft thread, simultaneously pushed into the second shed to occupy the position illustrated in FIG. 1. The introduced weft thread loop is then abutted by the reed 13 against the edge of the fabric strip in the vicinity of the reed abutment location 4 and tied by a tying member (not shown). In that case, the read 13 simultaneously transports the free end portion 11*a* of the rod 11 into the region of the web abutment location 4, so that the portion 11*a* can be secured by the gripper 26.

As can be deduced from the FIG. 2, an intermediate portion 11*c* of the rod 11, which is disposed outside the region of the warp threads, namely between these and the slotted part of the sleeve 10, is in that case elastically bent or deformed against the reed abutment location 4. The rearward part of the rod with the thickened portion 11*b* is in that case held fast in its position by the sleeve 10 serving as guide. The gripper 26 on the other hand retains the free end portion 11*a* of the rod 11 in such a manner, in the region of the reed abutment location 4, that it extends in a plane perpendicular to the longitudinal direction of the tape and thus also to the transport direction 3. The end portion 11*a* is retained in such a manner, that it rests on the upper side of the basic fabric or is disposed even somewhat above this.

When the inserted weft thread section and the end portion 11*a* of the rod 11 are transported to the web abutment location 4, a change of shed simultaneously takes place. In that case, the pile warp threads 9*b*, disposed at the start of the weaving cycle in the third warp thread layer 9, are displaced into the lowermost warp thread layer 7. The pile warp threads 9*b* then run around the rod 11 and thus form a series of nap loops 2*b*. So that these loops 2*b* are not pulled into the basic fabric 2*a* on the pulling up of the pile warp threads, the rod 11 must be held fast at least until the beating up of the next weft thread, that is until the next woof is inserted and abutted against the reed abutment location 4. In the case of this weft insertion following the nap loop formation, it is immaterial whether a second shed is formed in that case or not. In this manner, the pile warp threads are woven into the basic fabric 2*a* in those regions of the tape 2 in which they do not actually form nap loops.

The free end portion 11*a* of the rod 11 now remains in the region of the fabric at least until the abutting of the next woof or during several woof insertions. In that case, the rod portion 11*a* is of course transported further with the newly formed fabric.

After the abutment of the next woof or after several woof insertions and shed changes, the rod 11 is again withdrawn from the region of the tape 2 by the pivot arm 14. The rod 11 is elastic so that it again stretches in that case and assumes its original undeformed shape. It can now again be pushed into the second shed for the formation of a further series of nap loops.

The pivot arm 14 must of course be driven synchronously with the shed forming device 12 and the weft thread insertion member. The guide sleeve 10 remains locally fixed during the entire operating cycle, as is evident from the preceding description. Furthermore, the rod 11 remains in operative connection with the drive member 15 during the entire operating cycle.

Since the rod 11 is flexible and displays only a negligible mass, it can, after the insertion, easily be transported just as quickly against the web abutment location 4 as the weft thread is abutted. On the withdrawal of the rod, 11 from the fabric, the rod in consequence of its elasticity, likewise very quickly springs back into its initial unflexed undeformed position. The power tape loom 1 described above therefore enables a nap fabric to be manufactured at substantially the same weaving speed as a normal fabric.

If the woven nap fabric is to be employed for the manufacture of tape fasteners, then the nap loops of a part of the tapes must still be cut open or be shaped, so that they can form coupling means. If the nap loops are to be cut open, the rod 11 can be provided at its free end with a small knife. Alternatively, the rod may be provided with a longitudinal groove, which can serve as guide and bearing surface for the cutting edge of a knife.

Expediently, the machine is equipped not with only one rod for the manufacture of each tape, but with several, for example with four rods. This makes it possible, for example, to form nap loops on each second shed change and nevertheless to leave the rods in the fabric during several shed changes. Trials have proved that it is possible to guide four rods in the same sleeve 10. Four drive members, i.e. pivot arms 14, are then present and each rod is connected with a separate pivot arm, so that the four rods can be pushed to and fro individually. The four pivot arms must then of course be spaced from one another, for example somewhat above one another and arranged to be staggered relative to one another in the plane of the fabric. Alternatively, a separate guide sleeve may, of course, be provided for each rod.

The thickness of the rod 11 can of course vary over its length. For example, its portion 11*c* can, for increasing the elasticity or flexibility, be somewhat thinner than the remaining sections.

In the manufacture of tapes for tape fasteners, it is sometimes expedient for the same tape to be provided with nap loops of different sizes. For this purpose, rods of different thickness can be inserted alternately.

In a particularly advantageous construction of the gripper means 26, the hooks 27 are displaceable in height. The hooks can then be so adjusted that the rod 11, at the reed abutment location 4, is disposed outside the plane of the tape, so that it is either above or below the basic fabric 2*a* and therefore no longer touches this. By displacement of the hooks, fabrics with nap loops of different size can be manufactured. Furthermore, nap loops can be formed, the size of which is different over the width of the tape, with a rod end portion 11*a* passing through the nap loops to be loosely encompassed thereby. In the manufacture of nap fabrics for turkish towelling, velvet, or other materials, the thickness of the rod end portion 11*a* and the tension of the pile warp threads are advantageously matched to one another in such a manner that equally large nap loops are formed over the entire width of the tape 2.

In the example of embodiment illustrated in the FIGS. 1 and 2, free end portion of the rod 11 is transported by the reed 13 to the reed abutment location 4. It would of course be possible to arrange the gripper means 26 to be so displaceable that it can seize the rod after the pushing-in and pull it to the reed abutment location 4.

Figure 3:
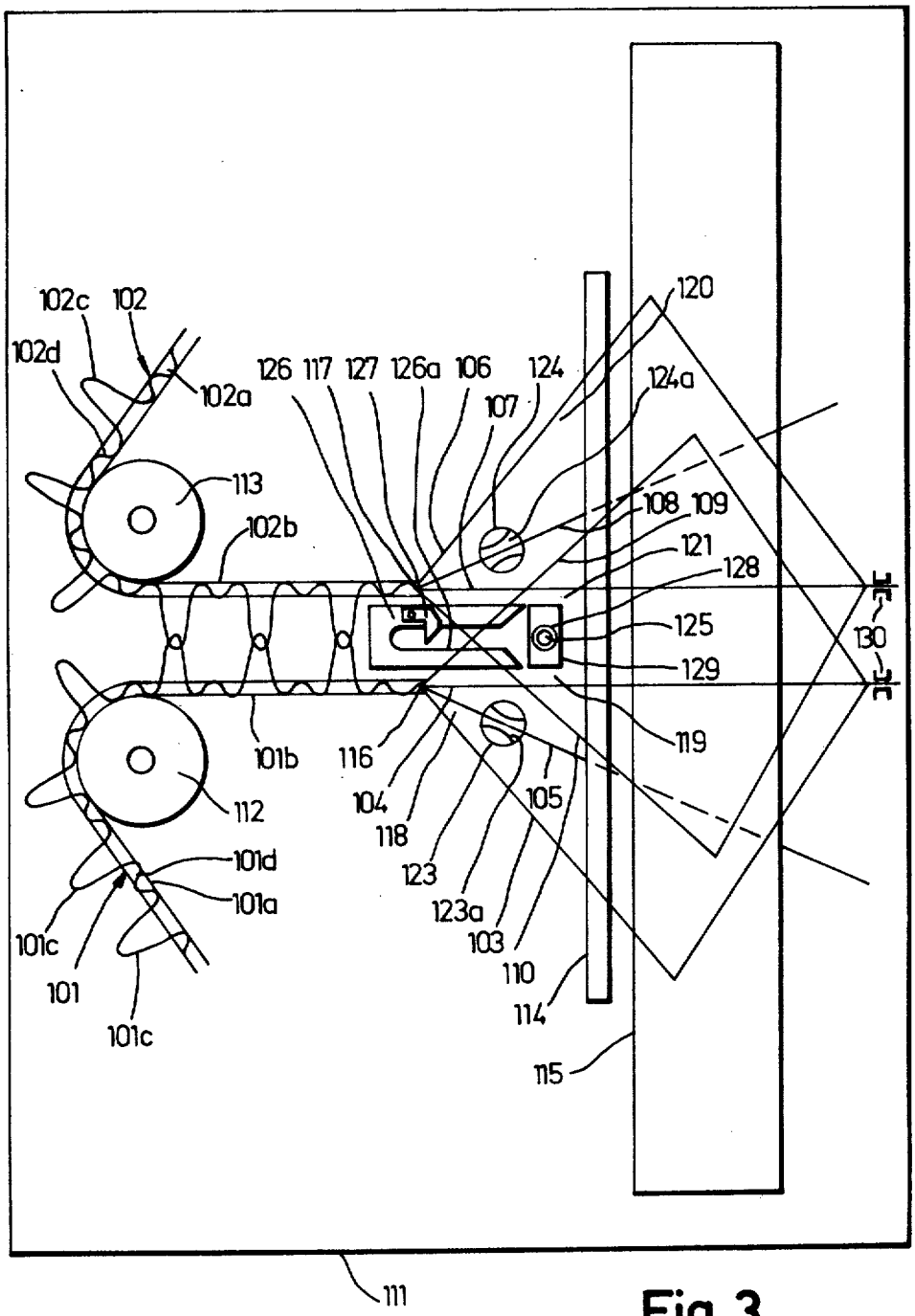
FIG. 3 is a side elevation of a power tape loom for the simultaneous manufacture of two tapes arranged over one another on the introduction of a rod into a common region of one shed each of the two tapes.
Figure 4:
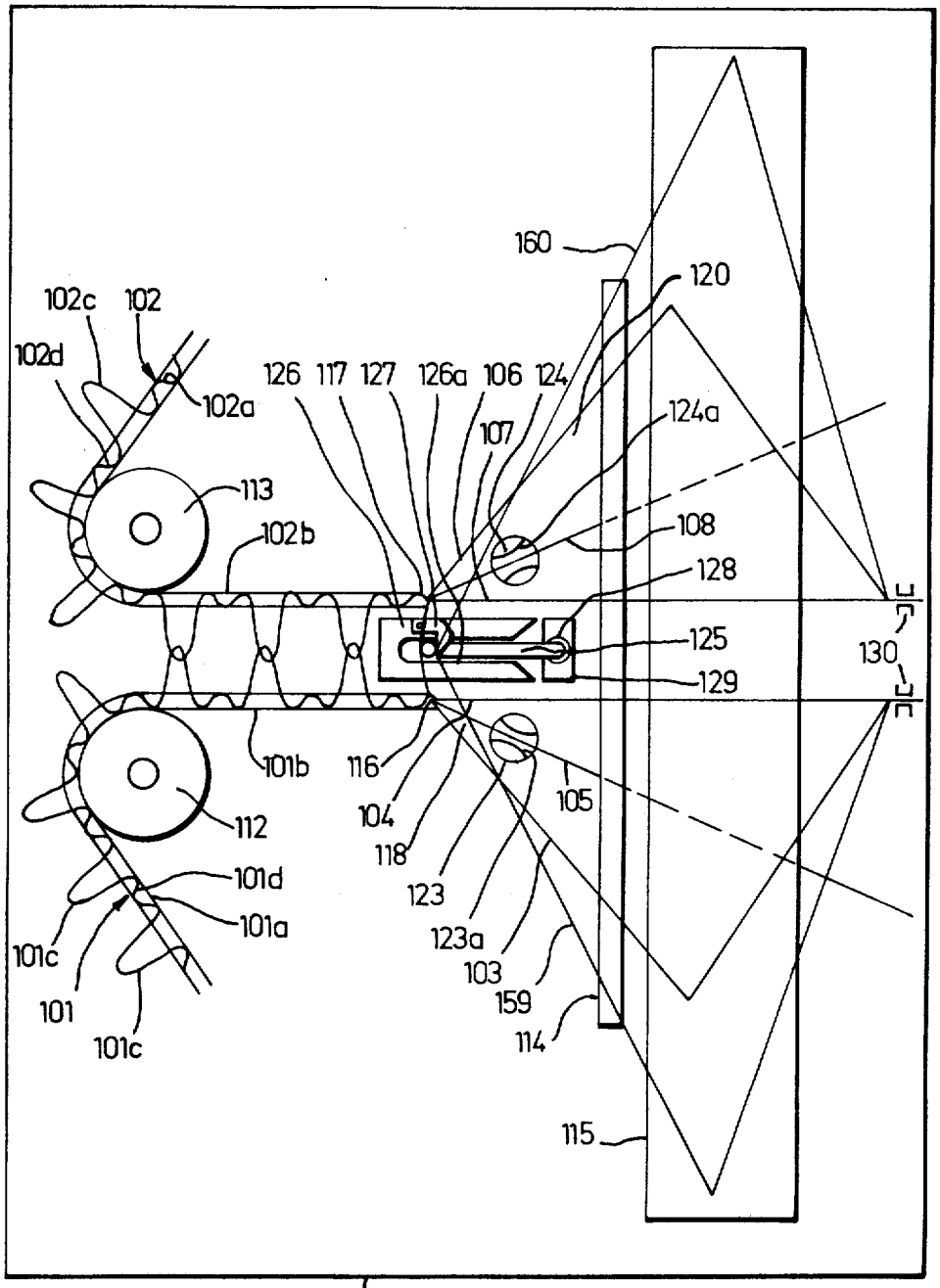
FIG. 4 is a side elevation corresponding to FIG. 3, however at a later instant in time.

Another example of a power tape loom is illustrated in FIGS. 3 and 4, in which the reference numerals 101 and 102 designate two nap fabric tapes. The tape 101 comprises a basic fabric 101*a*, which is formed of basic warp threads as well as a weft thread 105. The tape 102 comprises a basic fabric 102*a*, which is formed of basic warp threads as well as of a weft thread 108. The tape 101 further contains pile warp threads, which form nap loops 101*c*. The sections 101*d* of the pile warp threads disposed between the loops 101*c* are woven into the basic fabric 101*a* of the tape 101. Similarly, the tape 102 contains pile warp threads, which form the nap loops 102*c* and therebetween display sections 102*d* woven into the basic fabric 102*a*.

The power tape loom serving for the manufacture of the tapes 101 and 102 includes a schematically indicated machine frame 111 and transport members, of which only the two rollers 112 and 113 are illustrated. Furthermore, a reed 114, a shed forming device 115 and thread guides 130 of the loom are evident. The two tapes 101 and 102 and the warp threads are guided through the rollers 112 and 113, through tape holders (not shown) as well as through the shed forming device 115 in such a manner, that they form sections 101*b* and 102*b*, respectively, extending parallel to one another with surfaces facing one another, between the rollers 112 and 113 and the edges of the goods, i.e. the reed abutments 116 and 117. The shed forming device 115 is constructed in such a manner that it can divide up the warp threads fed to the tape 101 into three layers in the case of a part of the shed formations. This is illustrated in FIG. 3. In that case, the layers 103 and 104, containing the basic warp threads, together form a first shed 118. The basic warp thread layer 104 and the layer 109 formed by pile warp threads together form a second shed 119. The basic warp threads fed to the tape 102 are likewise divided up into two layers 106 and 107 and form a first shed 120. The basic warp thread layer 107 and the layer formed by the pile warp threads together form a second shed 121. The two pile warp thread layers 109 and 110 cross one another, so that the two second sheds 119 and 121 form a common region. The loom has two weft thread insertion members 123 and 124, formed by needles, the free ends of which are provided with a notch 123*a* and 124*a*, respectively, for seizing the weft thread 105 and 108, respectively. The two weft thread insertion members 123 and 124 can be introduced into the first sheds 118 and 120 by means of a not shown drive device and again be withdrawn therefrom. Furthermore, a resiliently or elastically deformable rod 125 is present. This is arranged in the central plane between the two tape sections 101*b* and 102*b*. The rod 125 is guided in a locally fixed sleeve 128 in such a manner that it can be pushed into the common region of the two second sheds 119 and 121 and again be withdrawn therefrom by means of a schematically illustrated drive member 129.

The rod 125 is resiliently or elastically deformable in such a manner that its end section when it has been pushed into the two second sheds, can be bent into the region of the two reed abutment locations 116 and 117 by means of the reed 114. On both sides of the warp thread, the loom expediently has a guide or gripper element 126 with a slot 126*a*, which guides the rod in the central plane between the two tape sections 101*b* and 102*b* when it is bent into the region of the reed abutment locations by the reed 114. A pawl 127 is articulated to each guide or gripper element 126. The two pawls 127 together form a gripper, which retains the rod 125, when this is disposed in the region of the reed abutment locations 116 and 117.

The operation of the power tape loom will now be described.

At the start of a cycle, the warp threads of each tape 101 and 102 are divided up into three layers 103, 104, 109 and 106, 107, 110, respectively, as is illustrated in FIG. 3 of the drawing, so that each time a first shed 118 and 120, respectively, and a second shed 119 and 121, respectively, arise. The weft threads 105 and 108 are then inserted into the two first sheds 118 and 120, respectively, by means of the weft thread insertion members 123 and 124, respectively. Each of the introduced weft threads then forms a loop, which is tied by means of a tying member (not shown). During the insertion process, the rod 125 is simultaneously pushed into the common region of the two second sheds 119 and 121. While the insertion members 123 and 124 are immediately again withdrawn, the rod 125 remains in the sheds and its inserted portion is now transported, with an elastic deformation, into the region of the reed abutment locations 116 and 117, together with the inserted weft thread loops, by the reed 114. There, it is retained by the pawls 127. During the next shed change, two first sheds 118 and 120, respectively, are again formed but no second sheds. The pile warp threads, which have previously formed the layers 109 and 110, respectively, now form the layers 159 and 160, respectively, as is evident from FIG. 4. The pile warp threads running halfway around the rod 125 now form nap loops 101*c* and 102*c*, respectively. The pile warp threads fed to the tape 101 pull the rod downwardly and the pile warp threads fed to the tape 102 pull the rod upwardly. The forces exerted by the pile warp threads upon the rod thus compensate each other, so that the rod extends exactly horizontally. During a few shed changes, during the which the warp threads are divided up into only two sheds each, the inserted end of the rod 125 now remains in the space region between the two tapes 101 and 102, while it is elastically deformed somewhat to the left by the tapes. In that case, the pile warp threads are woven into the basic fabrics, so that the pile warp thread sections 101*d* and 102*d* are formed. The rod 125 is then withdrawn laterally of the sheds and, in consequence of its elasticity, again springs back into the initial position or orientation. Now, three sheds can again be formed and a new operating cycle be started.

The method described above has, as mentioned, the advantage that the rod is not bent out of the central plane between the two tape sections 101*b* and 102*b*. A further advantage consists in that it makes it possible to employ the same rod for the simultaneous manufacture of two tapes.

Of course, this machine can also be equipped with several rods, which are one after the other pushed into the sheds, abutted, transported one piece away by the two fabrics and then again withdrawn.

Figure 3A:
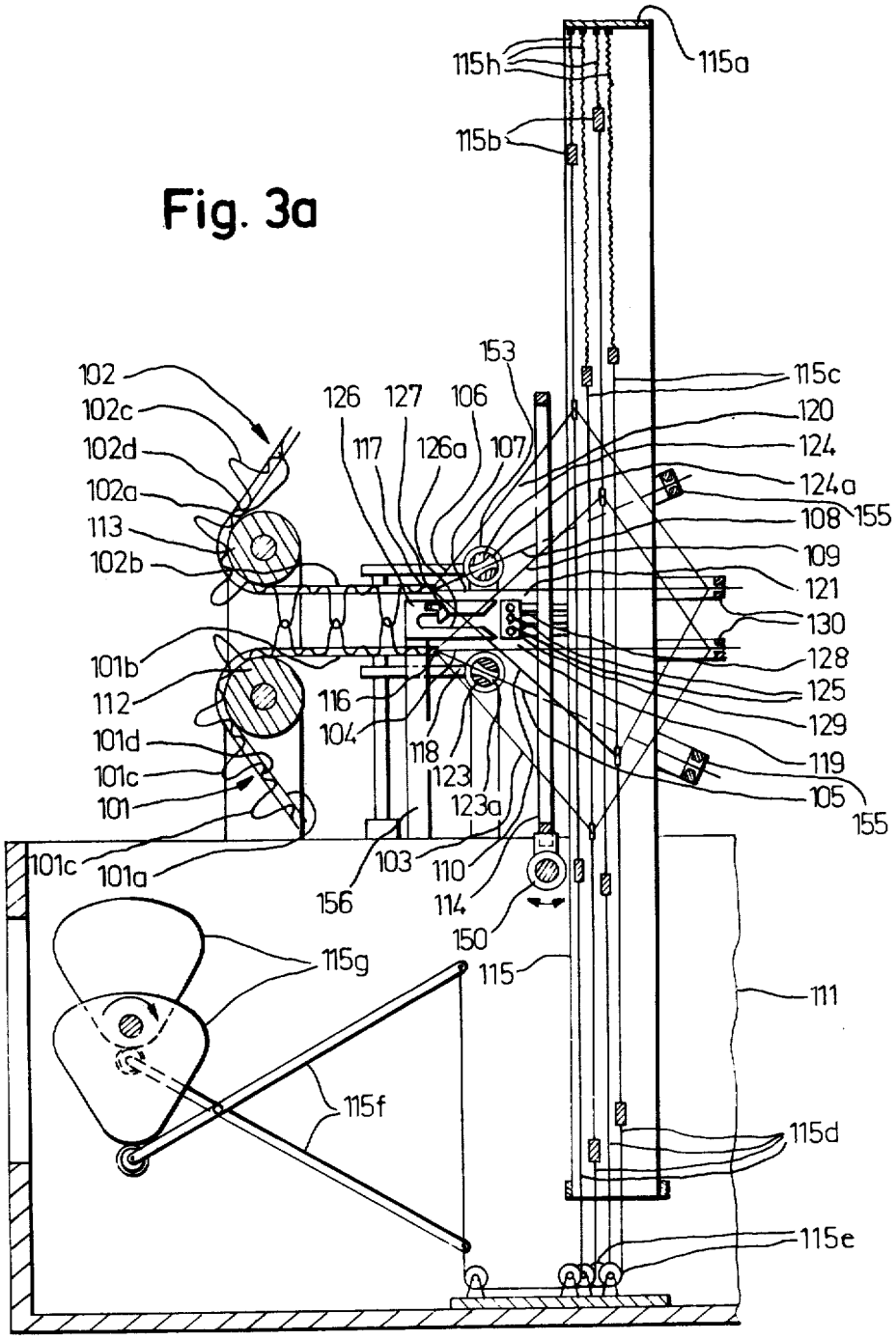
FIG. 3*a* is a side elevation view corresponding to FIG. 3 and showing details of the power tape loom.
Figure 4A:
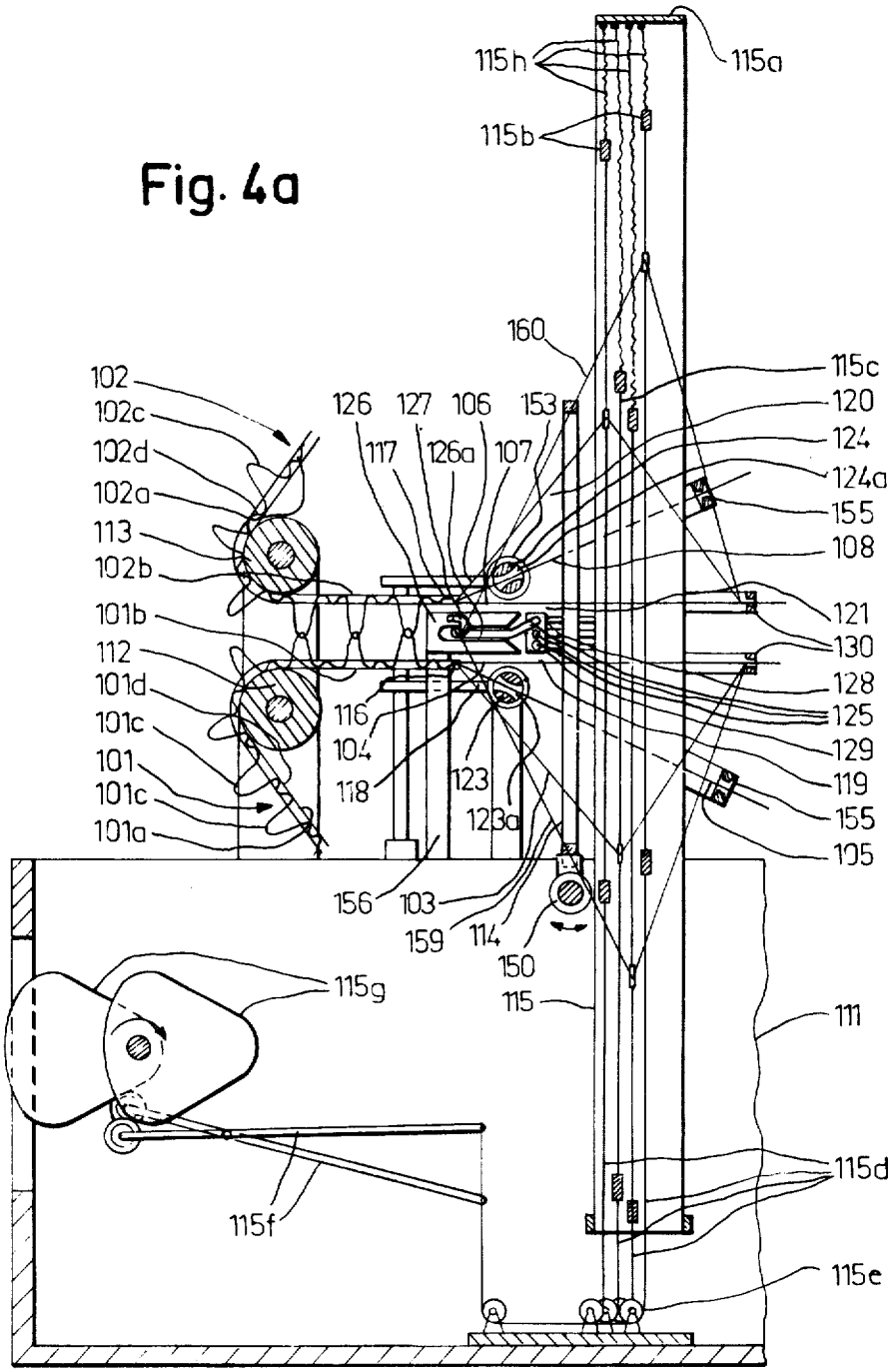
FIG. 4*a* is a side elevation view, corresponding to FIG. 3*a*, but showing details of the power tape loom at such later instant in time.
Figure 4B:
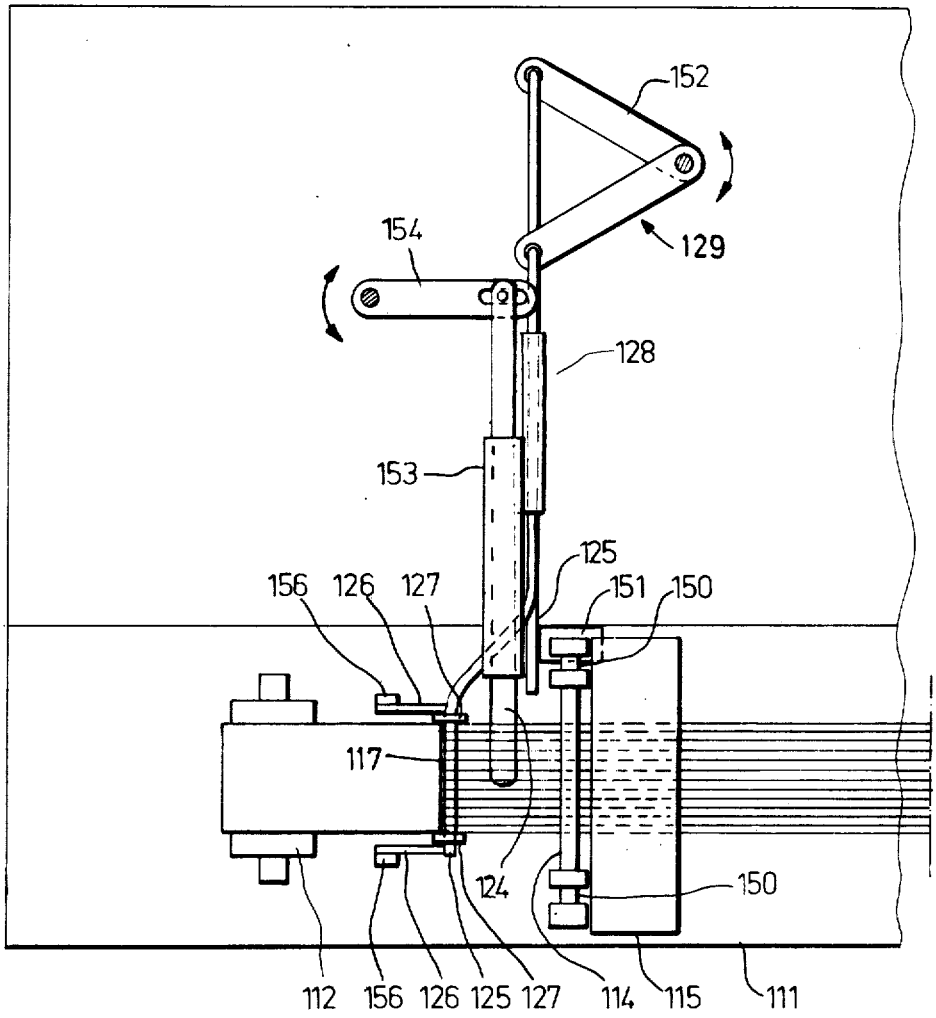
FIG. 4*b* is a plan view of the power tape loom shown in FIGS. 3, 3*a*, and 4*a*.

FIGS. 3*a*, 4*a* and 4*b* illustrate, in substantially greater detail, as to important components, the power loom structure shown more schematically in FIGS. 3 and 4. Referring to FIGS. 3*a* and 4*a*, the shed-forming device 115 comprises a frame 115*a*, heald shafts 115*b*, healds 115*c* provided with eyelets, strings 115*d*, rollers 115*e*, levers 115*f*, drive disks 115*g* and restoring springs 115*h*. Rollers 115*e*, levers 115*f*, and drive disk 115*g* are shown in a somewhat schematic arrangement and, in practice, are preferably arranged so that each string 115*b* can be fixed to a corresponding heald shaft 115c in the middle of the lower edge of the latter.

FIGS. 3a, 4a and 4b further illustrate three of the resiliently and elastically deformable rods 125, one above the other, as can be best seen in FIGS. 3a and 4a, with each rod 125 being guided in a respective bore of a common guide 128 fixed to frame 111. Referring more specifically to FIG. 4b, this figure illustrates the drive means 129 for actuating the resiliently and elastically deformable rods 125. Drive means 129 comprises a separate operating arm 152 for each rod 125, and the three arms 152 are rotatable about a common axis but can be moved independently of each other. For example, the three arms 152 can be fixed on the ends of respective coaxially telescoped shafts, including an inner hollow or tubular shaft, an intermediate tubular shaft and an outer tubular shaft.

At the instant in time represented in FIGS. 4a and 4b, the uppermost rod 125 has been inserted between the warp threads and bent to the region between the two reed abutment locations 116 and 117, while the two layer rods 125 are still outside the warp threads.

FIGS. 3a, 4a and 4b further illustrate pivots 150 for the reed 114, and schematically illustrate a drive box 151 for swinging the reeds. Guides 153 are fixed to frame 111 for guiding the weft inserting members 123 and 124, and guides 155 are fixed to the frame for guiding the weft threads. FIG. 4b further illustrates a drive means 154 for operating the weft inserting members 123 and 124, which are moved simultaneously with each other. Finally, FIG. 4b illustrates mounting members 156 for fixing the guide or gripper elements 126 to frame 111.

Figure 5:
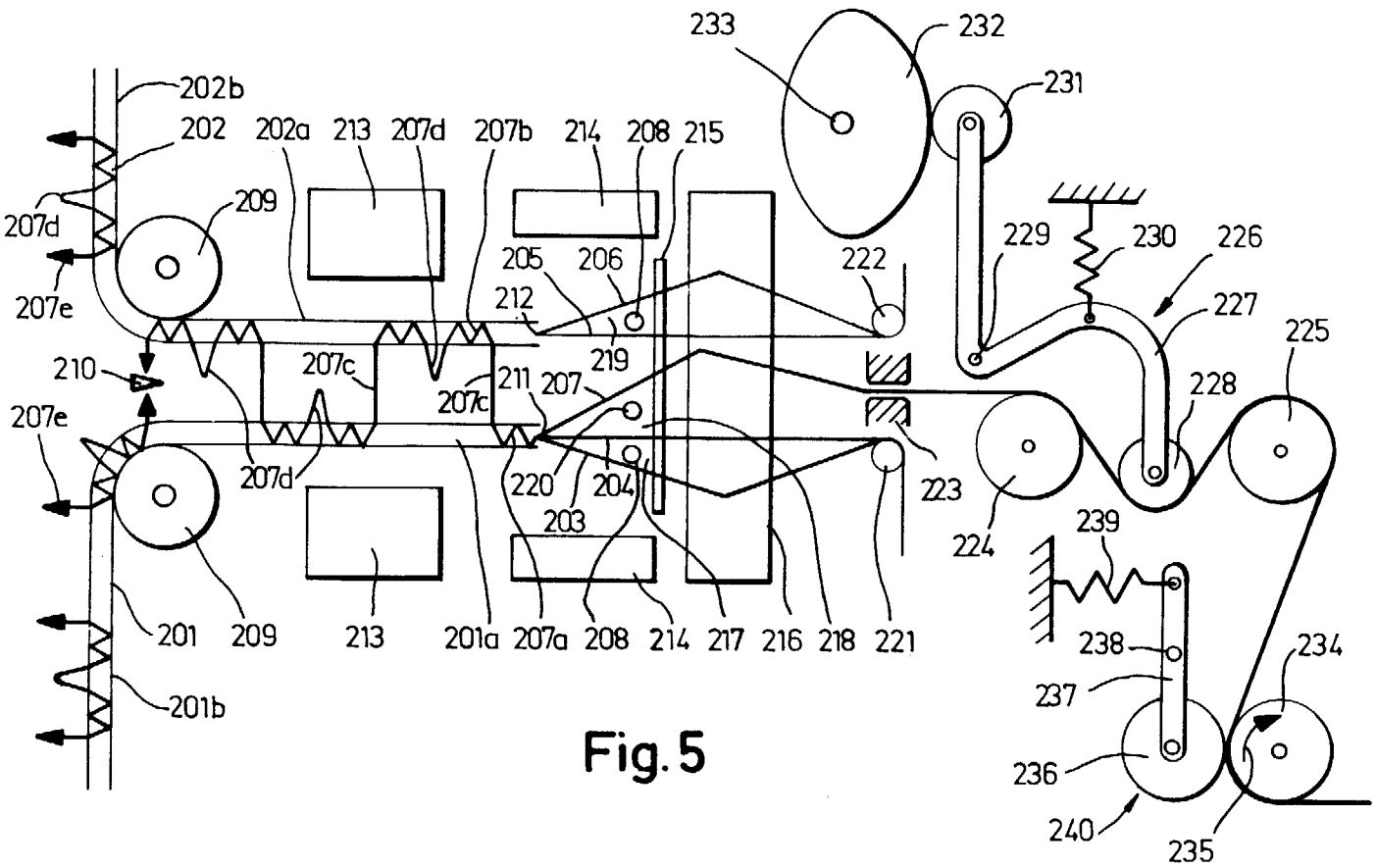
FIG. 5 is a side elevation of a power tape loom to form pile warp threads alternately into nap loops and connecting sections between two tapes.

Illustrated in FIG. 5 is a further example of a shuttleless power tape or strip loom, which serves for the manufacture of nap fabric tapes for tape fasteners. It will be understood that the components of the power loom structure, shown in FIG. 5, schematically, may be the same as the those illustrated more specifically in FIGS. 3a, 4a, and 4b. In FIG. 5, 201 and 202 designate two nap fabric tapes. The tape 201 comprises a basic fabric 201b, which is woven from a basic warp formed by the basic warp threads 203 and 204 as well as a not shown weft thread. The tape 202 comprises a basic fabric 202b, which is woven from the warp threads 205 and 206 as well as a likewise not illustrated weft thread. During weaving, the two tapes 201 and 202 are transported by transport members, of which only the two rollers 209 are illustrated, and guided through not illustrated tape holders in such a manner that they form two sections 201a and 202a extending parallel to one another between the reed abutment locations 211 and 212 and the rollers 209. For the remainder, the section 202a is disposed exactly above the section 201a, so that the upper surface of the basic fabric 201b is facing the lower surface of the basic fabric 202b.

Further illustrated in FIG. 5 is a reed 215 serving for the abutting of the weft threads and a shed forming device 216. During the weaving, pile warp threads 207 are fed through the device 216 additionally to the basic warp threads 203, 204, 205 and 206 and serve for the formation of nap loops 207d and nap piles 207e with deformed free ends. The pile warp threads 207 are raised and lowered by the shed forming device 216 in such a manner that they are alternately woven into the basic fabric 201b of the lower tape section 201a and into the basic fabric 202b of the upper tape section 202a. The pile warp threads 207 can, for example on two successive shed changes, execute the same movements as the basic warp threads 204 of the lower basic warp and also on the two shed changes, together with the basic warp, each time form a lower shed. The basic warp threads 205 and 206 in this phase each time simultaneously form an upper shed.

After each shed formation, a weft thread loop is then inserted into the lower and the upper shed by a respective weft thread insertion member 208, subsequently seized by a tying member and tied and abutted by the reed 215 against the reed abutment location 211 and 212, respectively. The pile warp threads 207 in that case form the sections 207a woven into the basic fabric of the lower tape 201. Subsequently, the pile warp threads 207 can be raised by the shed forming device 216 into the position illustrated in FIG. 5. At this instant, the basic warp threads 203 and 204 form a first lowermost shed 217. The basic warp threads 204 and the pile warp threads 207 form a second shed 218 thereover. The warp threads 205 and 206, serving for the weaving of the upper tape 202, are divided up into a shed 219. A respective weft thread loop is then inserted into the lowermost first shed 217 and the uppermost shed 219 and seized by a tying member. By contrast, a resiliently or elastically deformable rod 220 is pushed into the second shed 218 belonging to the lower tape 201. When the inserted wefts have now been abutted against the reed abutment locations 211 and 212 by the reed 215 and been tied, the free rod end section pushed into the shed 218 is bent by the reed 215 to the reed abutment location 211. The rearward part of the rod is in that case retained in its position by a (not shown) guide member. The pushed-in end section of the rod is retained in the region of the reed abutment location 211 analogously with the already described examples of embodiment. The pile warp threads 207 running around the rod 220 now form a series of nap loops 207d. After the formation of these nap loops 207d, the pile warp threads 207 are woven into the tape 201 during about two shed changes. After the abutting of the woof following upon the loop formation, or after several weft insertions and shed changes, the rod 220 is again withdrawn from the region of the tape 201. The rod 220 is elastic in such a manner that it, in that case, again assumes its original undeformed or original shape. It is now ready for the formation of a further series of nap loops. Subsequently, the pile warp threads 207 are raised to the uppermost basic warp thread layer of the upper basic warp. In that case, the pile warp threads 207 form connecting sections 207c, which connect the two basic fabrics 201b and 202b with one another in the tape sections 201a and 202a, respectively. The connecting sections 207c in that case extend approximately perpendicularly to the two tape sections 201a and 202a.

The pile warp threads 207 are then woven into the upper tape 202 during about two shed changes, so that the thread sections 207b are formed. With the aid of a further, not illustrated rod, nap loops 207d can likewise be formed in the upper tape 202.

The power tape loom includes heater elements 214, for example infar-red radiators of hot air blowers, in the region between the shed forming device 216 and the reed abutment locations 211 and 212, respectively. In a particularly expedient construction, the reed 215 is additionally likewise provided with a heater element. The warp threads can be heated in the region of the sheds and the edge of the goods by these heater elements. This has the advantage that the pile warp threads consisting of synthetic material, which are normally somewhat stiffer than the remaining threads, become flexible and can be woven tightly into the basic fabric. Furthermore, the pile warp threads are melted somewhat at the surface by the heating, so that they adhere at the remaining threads and can be anchored well in the basic fabric.

Arranged between the reed abutment locations 211 and 212 and the rollers 209 are cooling elements 213, possibly air blowers, by which the fabric is again cooled down to room temperature. Plates, resting against the tapes and possibly cooled by water, can also be employed as cooling elements in place of air blowers. The connecting sections 207*c* are stabilised in their vertical position by the cooling down. A severing heating member 210, which extends over the entire width of the tapes 201 and 202, is arranged at the rollers 209 in the middle between the two tape sections 201*a* and 202*a*. The severing heating member 210 can perhaps be formed by a heating wire, which is traversed by current and which displays a wedge-shaped cross-section. The acute-angled end of the wedge is in that case facing the shed 216. The severing heating member 210 is expediently tensioned by springs for compensating the change in length taking place on heating up. Furthermore, a monitoring member is advantageously present, which switches off the power tape loom on tearing or melting through of the severing heating member 210.

When, during the transport of the tapes, one of the connecting sections 207*c* gets to the severing heating member 210, then it is severed by this into two parts. The temperature of the severing heating member 210 is in that case so chosen that it can melt the pile warp threads at the separating locations, so that a deformation ensues and the free ends of the pile warp threads are thickened. In this manner, mushroom-shaped or club-shaped nap piles 207*e* are formed, which completely rigidify again on the subsequent cooling down. The tape 201 is then deflected downwardly around the lower roller 209 and wound up on a not illustrated winding device. The tape 202 is then deflected upwardly around the upper roller 209 and likewise wound up.

In a particularly expedient execution of the method, basic warp threads and weft threads, of a material which is not meltable or displays a higher melting point than the material of the pile warp threads, is employed for the manufacture of the two tapes. For example, cotton or polyamide (nylon) threads can be employed for the manufacture of the basic fabrics and polypropylene threads for the formation of the nap piles.

The basic warp threads are fed to the shed forming device 216 from a feed device with warper's bobbins or warp beams. Only two guide rollers 221 and 222 of this feed device are illustrated in the FIG. 5.

A separate feed device, which will now be described, is provided for the feed of the pile warp threads serving for the formation of the nap piles. This feed device includes a feed member 240, which is provided with a drive roller 234, which is driven in the direction of the arrow 235, and with a roller 236, which is mounted to be freely rotatable in a lever 237. A spring 239 engages the lever 237, which is mounted by a bolt 238 to be pivotable in the machine frame, so that it urges the roller 236 against the drive device 234.

The pile warp threads 207 are guided through between the two rollers 234 and 236 and are therefore, in operation, constrainedly withdrawn at constant speed from the warper's bobbins or from a warp beam. The speed of rotation and the diameter of the drive roller 234 are in that case so matched to the operating speed of the power tape loom that the feed speed of the feed member 240 corresponds to the median thread requirement.

The pile wrap thread feed furthermore includes a storage mechanism 226. This is provided with two guide rollers 224 and 225, which are mounted somewhat spaced from one another to be freely rotatable and over which the pile wrap threads are guided. A lever 227, which is mounted by a bolt 229 to be pivotable, further belongs to the storage mechanism 226. The lever 227 at one end displays a roller 228, which is disposed in the region of the gap between the two guide rollers 224 and 225 and which engages the pile wrap threads 207. A feeler roller 231 is mounted at the other end of the lever 227. A tension spring 230 furthermore engages the lever 227 in such a manner that the feeler roller 231 is urged against a cam disc 232, which is seated rotationally fast on a drive shaft 233. The lever 227 thus forms a thread tensioner. A pusher could of course also be used as a thread tensioner in place of a lever. The pile warp threads 207 are then fed from the storage mechanism 226 through a guide 223 to the shed forming device 216.

The drive shaft 233 and the cam disc 232 together form a device member 232 and 233 which, in operation, executes a rotational movement synchronous with the movement of the shed forming device 216. When the cam disc 232 rotates, the roller 228 approximately performs an up and down movement. When it moves downwardly, thread sections are stored between the guide rollers 224 and 225. In that case, the speed, at which the pile warp threads are fed to the shed forming device, is reduced. When by contrast the roller 228 moves upwardly, the stored thread sections are released and the pile warp threads correspondingly fed to the shed forming device 216 at greater speed. The cam disc 232 is so constructed that the pile warp threads 207 are fed relatively slowly during those intervals of time in which they are woven into one of the basic fabrics. In the case of those shed changes, during which the connecting sections 207*c* or the nap loops 207*d* are formed, the pile warp threads 207 are then fed at greater speed corresponding to the greater thread requirement.

The storage mechanism 226 thus makes it possible always to feed the pile warp threads 207 to the shed forming device at just the right speed corresponding to the requirement. Thereby, it can be avoided, even in the employment of stiff pile warp threads, that great tensions arise in the formation of the connecting sections 207*c* and the nap loops 207*d*. This makes it possible appreciably to increase the weaving speed.

Instead of producing the connecting sections and nap loops from the same pile warp threads, as described in the preceding, different kinds of thread can be employed for the formation of the connecting sections and for the formation of the loops. It is, for example expedient for the formation of the mushroom-shaped piles to employ threads of full cross-section, that means monofilament threads, and for the formation of the loops to employ threads of several filaments. Since the latter are relatively flexible, they need not necessarily be fed through the storage mechanism.

Figure 6:
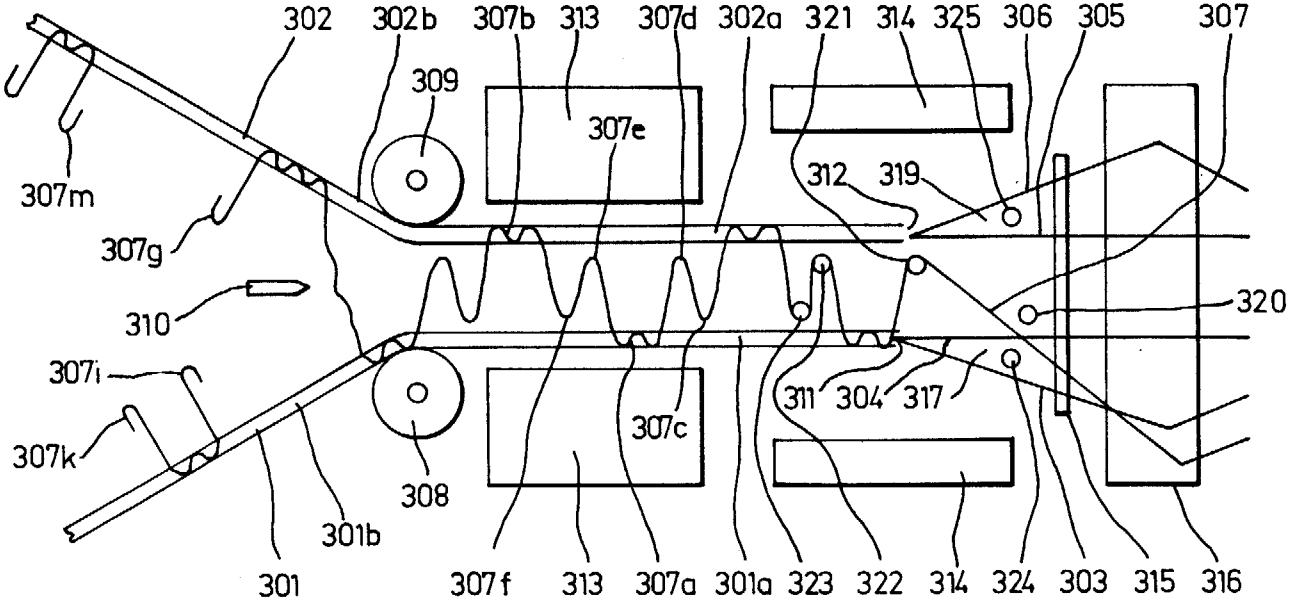
FIG. 6 is a side elevation of a power tape loom to form S-shaped connecting sections.
Figure 7:
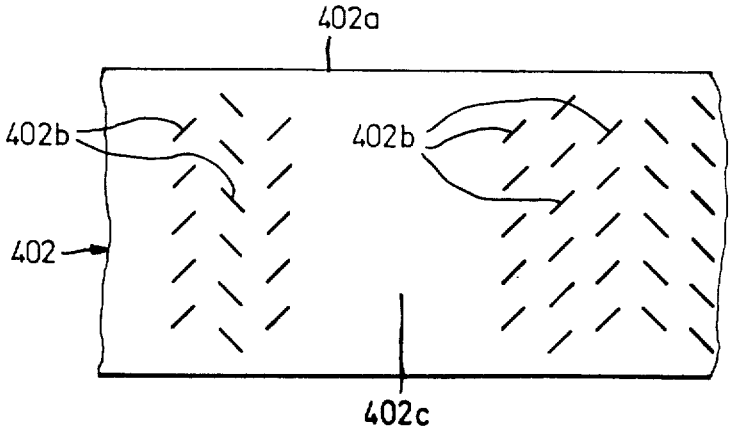
FIG. 7 is a plan view of a tape section, wherein the nap loops have been illustrated in exaggerated size for clarification.
Figure 8:
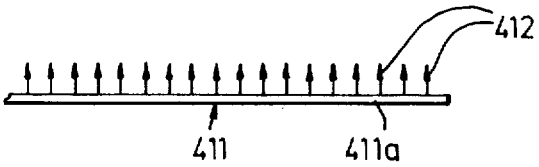
FIGS. 8 to 11 show respective schematic side elevations of different tapes.
Figure 9:
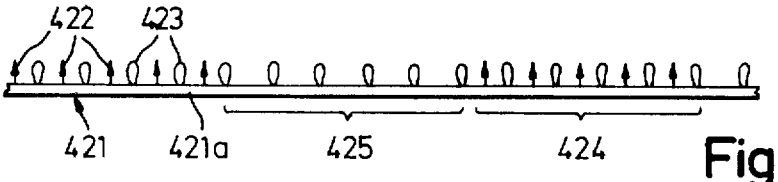

With reference to FIG. 6, a method will now be described by which tapes with hook-shaped nap piles can be manufactured. In this method, two tapes 301 and 302 are again woven with basic fabrics 301*b* and 302*b*, respectively. The two basic fabrics are woven from the basic warp threads 303, 304 and 305, 306, respectively, as well as not shown weft threads. The two tapes 301 and 302 are guided in such a manner, that they form sections 301*a* and 302*a,* respectively, extending parallel to one another between the reed abutment locations 311 and 312, respectively, and the rollers 308 and 309, respectively.

During the weaving, the basic wrap threads of the two tapes are divided up into sheds 317 and 319 by a shed forming device 316. Weft thread loops are then inserted into these sheds by weft thread insertion members 324 and 325 and abutted by the read 315.

Pile warp threads 307 are furthermore fed through this shed forming device 316. These are woven into the two basic fabrics each time during a time interval, so that the sections 307*a* and 307*b* are formed. Therebetween, the pile warp threads 307 form connecting sections, which connect the two tape sections 301*a* and 302*a* with one another. By contrast to the example illustrated in FIG. 5, not straight but S-shaped connecting sections are however formed here.

The formation of these connecting sections will now be more fully described. Initially, the pile warp threads 307 are fed through the shed forming device 316 about so that they are woven into the tape 301. Then, a first shed is formed form the basic warp threads and a second shed from the pile and basic warp threads. In that case, the pile warp threads are raised so far, by the shed forming device 316, that a resiliently or elastically deformable rod 321 can be pushed below them in the upper half of the gap between the two tapes. The pile warp threads are in that case however raised only so far that they are not woven into the upper tape.

On the next shed change, the pushed-in end section of the rod 321 is bent in the proximity of the reed abutment location 312 by the reed 315 into the position illustrated in FIG. 6 and there retained by a gripper. The pile warp threads are now lowered downwardly, as is evident in FIG. 6. This lowering ensues so far that the resiliently or elastically deformable rod 320, disposed in the region of the lower half of the gap between the two tapes, can be pushed over the pile warp threads 307 without the latter being woven into the lower tape 301.

On the next shed change, the pile warp threads 307 are then raised so far that they are woven into the upper tape. Simultaneously, the rod 320 is bent by the reed into the proximity of the reed abutment location 311 of the lower tap 301.

The thread sections running around the rod 321 then form the loops 307*d.* The loops 307*c* result on running around the rod 320. The pile warp threads are heated with the aid of the heater elements 314 during the loop formation and then cooled with the aid of the cooling elements 313 during the further transport of the tapes. The loops are stabilised thereby, so that stable connecting sections 307*c* and 307*d* result with the already mentioned S-shape.

It is expedient for the rods 320 and 321 still to remain in the loops somewhat beyond the reed abutment locations so that exactly the desired S-shape results. They are in that case advantageously transported with the tape by the not illustrated gripper.

The S-shaped connecting sections 307*e* and 307*f* can then be formed in corresponding manner by the same rods or — as is illustrated in FIG. 6 — by two further resiliently or elastically deformable rods 322 and 323.

The four rods 320, 321, 322 and 323 can each be constructed similarly to the rod 11 as illustrated in the FIGS. 1 and 2. For loop formation, they can then each be pushed by respective drive devices approximately perpendicularly to the warp threads into the gap between the two basic warps 303, 304 and 305, 306, respectively.

The tapes 301 and 302, respectively, are deflected at the rollers 303 and 309 and drawn apart. In that case, the connecting sections are stretched. At that location, where they are entirely stretched, they are cut in two in the middle by a serving member 310.

The serving member 310 may, for example be a band-shaped knife which is moved to and fro. It shall in any case be of such character that no thickenings result at the severing locations. After the severing, the now halved connecting sections again assume their curved shape, so that the hooks 307*g,* 307*i,* 307*k* and 307*m* arise out of the originally S-shaped connecting sections 307*c,* 307*d,* 307*e* and 307*f.*

A few examples of tapes which can be manufactured with the described method and machines will now be described with reference to FIGS. 7 to 11. When tapes displaying nap loops are manufactured for tape fasteners by means of one of the machines illustrated in the FIGS. 1 to 5, it is expedient for the pile warp threads to be woven into the basic fabric in such a manner that the nap loops of the end product stand diagonally and that the nap loops of different rows or groups of rows extend in different directions. Such a nap fabric tape 402 with a basic fabric 402*a* and nap loops 402*b* is illustrated in the FIG. 7. This form of tape construction has the advantage that a tape fastener including such tapes closes substantially better than when all nap loops 402*b* extend in the same direction. In particular, a strength relatively independent of the direction of pull thereby results on tension loadings in the plane of the tape. Furthermore, the tape can display sections 402*c* free of nap piles.

When tapes are formed on one of the machines illustrated in the FIGS. 1 to 4 with nap loops, the latter can subsequently be shaped by a thermal treatment into muchroom-shaped nap piles and stabilised. In this manner, the nap fabric tape 411 illustrated in FIG. 8 can be formed, which displays a basic fabric 411*a* and nap piles 412.

In the case of the machine illustrated in FIG. 5, the shed forming device and the storage mechanism can be so controlled that connecting sections are formed only during certain intervals of time. When nap loops are in that case formed continuously, a tape of the kind illustrated in FIG. 9 arises. This tape designated generally by the reference numeral 421 includes a basic fabric 421*a* and sections 424, which are provided with mushroom-shaped nap piles or knubs 422 and with nap loops 423. Sections 425, in which only nap loops are present, are disposed between the sections 424.

Figure 10:
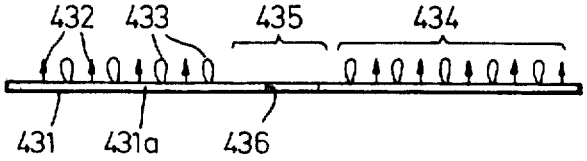
Figure 11:
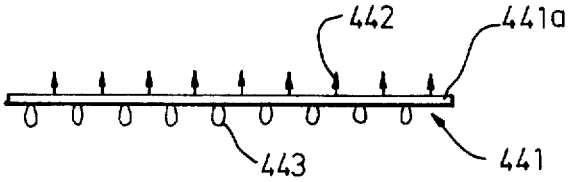

When the formation of the nap elements is also interrupted, a tape of the kind illustrated in FIG. 10 can be manufactured. This is designated as a whole by 431 and is provided with a basic fabric 431*a.* In the sections 434, the tape 431 is provided with mushroom-shaped piles or knubs 432 and with loops 433. Disposed therebetween are sections 435, in which neither mushroom-shaped piles nor loops are present. In the sections 435, holes 436, for example, may be stamped out, which make it possible to fasten the tape by buttons.

The length and width of the sections 435 shall be at least equal to the spacing of several nap piles. Furthermore, the boundary lines of the sections 435 include at least one portion not extending parallel to the longitudinal edges of the tape or strip, i.e. at least one portion of such boundary line extends transversely to the longitudinal edges of the strip. The sections free of nap piles then extend expediently over the entire width of the tape, as the sections 402*c* in the FIG. 7.

On the closing of the tape fastener, a hooking together of course takes place only where both tapes are provided with coupling means in the form of mushroom-shaped nap piles or knubs and with nap loops, respectively. On the bending of the fastener, the two tapes can bend independently of one another in the regions not coupled. As is known, the bending resistance of an element is very strongly dependent upon the thickness thereof. Two freely movable individual tapes therefore have a much smaller bending resistance than two tapes coupled together to a relatively thick double tape. When the tape fastener has regions which are not coupled, it is substantially more flexible than in the case of tape fasteners provided on the entire surface with coupling means. The greater flexibility in particular makes it possible without effort to close tightly and smoothly even longer tape fasteners without formation of waves. Since the flexible tapes adapt themselves well to articles of clothing, they can also be employed as edge bindings as well as for fasteners of knitted goods. Furthermore, the manufacture of the tape fasteners is cheapened, since less nap thread is required and fewer piles are to be formed.

The resiliently or elastically deformable rods serving for the formation of the nap loops can also be arranged on the outer sides of the tape in the case of the machine illustrated in FIG. 5. In this manner, the tape 441 illustrated in the FIG. 11 can be manufactured, which is provided with a basic fabric 441*a* and on one side displays mushroom-shaped nap piles 442 and on the other side nap loops 443.

It is of course also possible with this modification so to control the shed formation and the pile warp thread feed that surface regions without piles and loops arise.

As already mentioned, it is possible, in the case of the machines illustrated in the FIGS. 1 to 4, on the one hand to provide several such deformable rods and on the other hand to provide the rods with knives. The knives can be so arranged that the nap loops are cut open at one of their sides, so that the one part of the cut-open nap loops forms a hook. If now the machine is equipped with several such rods for each tape and a part of these is equipped with knives tapes can be manufactured, which display loop-shaped as well as also hook-shaped nap piles. Furthermore, such tapes can also be formed by a combination of the machines illustrated in FIGS. 5 and 6.

I claim:

1. A method of weaving at least one nap fabric strip in a shuttle-strip loom, the method comprising the steps of: forming a first shed from a first layer of warp threads and from a second layer of warp threads; forming a second shed from said second layer of warp threads and from a third layer of warp threads; introducing a weft thread into said first shed; introducing a free end portion of an elongate resiliently and elastically deformable element into said second shed to extend perpendicular to the warp thread direction; bodily displacing the free end portion of said elongate resiliently and elastically deformable element towards the rear edge of said fabric strip, while maintaining it substantially perpendicular to the warp thread direction and maintaining a portion of said elongate resiliently and elastically deformable element, external of and spaced from said second shed, against movement in the warp thread direction, such that an intermediate portion of said elongate element, external of said second shed, is deformed in the direction of warp thread movement with portions of said third warp threads partially surrounding the free end portion of said deformable element to form nap loops; securing the free end portion of said resiliently and elastically deformable element in the deformed displaced position at least until the beating up of the next weft thread; and then withdrawing said elongate deformable element laterally from said second shed, whereby, in consequence of its resilent and elastic deformability, said elongate deformable element returns to its initial undeformed shape.

2. A method as defined in claim 1, wherein the free end portion of said elongate deformable element is introduced into said second shed by drive means connected to said portion of said elongate element, external of and spaced from said second shed, which drive means remains in operative connection with said elongate element during an entire operating cycle of said shuttle-less strip loom.

3. A method as defined in claim 1, wherein said elongate element is reciprocable along guide means, which remain stationary at least during an entire operating cycle of said shuttle-less strip loom.

4. A method of weaving two nap fabric strips in a shuttle-less strip loom, the method comprising the steps of: forming two first sheds from respective first and second layers of warp threads; forming two second sheds from each second layer of warp threads and a respective third layer of warp threads; introducing a respective weft thread into each said first shed; introducing a free end portion of an elongate elastically deformable element into said second sheds; displacing said elongate element towards the rear edge of said fabric strip such that an intermediate portion of said elongate element external of said second sheds is deformed with portions of said tird warp threads partially surrounding said elongage element to form nap loops; securing said elongate element in the deformed position at least until the beating up of the next weft threads; and then withdrawing said elongate element from said second sheds; whereby, in consequence of its elasticity, said elongate element returns to its initial underformed shape; said two nap fabric strips, downstream of the fabric edges, being disposed in mutually facing relationship, and the two strips being woven simultaneously in said shuttleless strip loom, with the warp threads, to form said nap loops, being fed through a shed forming device to be woven into the respective nap fabric strips alternately so that portions of said warp threads interconnect the two strips; and then severing said interconnecting portions.

5. A method as defined in claim 4, including guiding said interconnecting portions of said warp threads along substantially S-shaped paths, stabilizing the shape of said interconnecting portions and then severing each of said stabilized interconnection portions to cause the resulting knubs to be hook-shaped.

6. A method of weaving two nap fabric strips in a shuttle-less strip loom, the method comprising the steps of: forming two first sheds from respective first and second layers of warp threads; forming second sheds from each second layer of warp threads and a respective third layer of warp threads; introducing a respective weft thread into each first shed; introducing a free end portion of an elongate elastically deformable element into said second shed; displacing said elongate element towards the rear edge of said fabric strip such that an intermediate portion of said elongate element, external of said second sheds, is deformed with portions of said third warp threads partially surrounding said elongate element to form nap loops; securing said elongate element in the deformed position at least until the beating up of the next weft threads; and then withdrawing said elongate element from said second sheds, whereby, in consequence of its elasticity, said elongate element returns to its initial undeformed shape; the two nap fabric strips, downstream of the fabric edges, being disposed in mutually facing relationship and the two nap fabric strips being woven simultaneously in said shuttle-less strip loom, with the respective warp threads of each of said two nap fabric strips being simultaneously spaced apart to cause the respective warp threads of each of said two nap fabric strips to be disposed in three layers; the second sheds of the two warp threads of the respective fabric strips being disposed in mutually facing relationship to define a region common to the two second sheds, and said free end portion of said elongate element being introduced into said common region.

7. A shuttle-less loom for manufacturing at least one nap fabric strip provided with a base fabric and with a plurality of nap loops, said loom comprising, in combination: a frame; a shed forming device operable to divide warp threads of at least one said strip into three mutually spaced layers of warp threads; thereby to form a first shed from first and second ones of said layers and to form a second shed from said second and the third one of said layers; means operable to introduce a weft thread into said first shed; guide means fixed against movement in the warp thread direction; a resiliently and elastically deformable elongate rod member reciprocably displaceable along said guide means; drive means operable to displace said elongate rod member along said guide means thereby to introduce a free end portion of said deformable elongate rod member into said second shed to extend perpendicular to the warp thread direction; means operable to displace the free end portion of said elongate rod member bodily towards the rear edge of said strip; while maintaining it substantially perpendicular to the warp thread direction with said guide means maintaining a portion of said elongate element, external of and spaced from said second shed, fixed against movement in the warp thread direction, in such a manner that an itermediate portion of said resiliently and elastically deformable elongate rod member, external of said second shed, is deformed in the direction of warp thread movement with portions of said warp threads of said second layer partially surrounding the free end portion of said elongate rod member to form said nap loops; and means operable to secure the free end portion of said elongate rod member in the deformed displaced position at least until the beating up of the next weft thread; said drive means being then operable to withdraw said elongate rod member laterally from said second shed, whereby, in consequence of its elasticity, said elongate rod member returns to its initial undeformed shape.

8. A loom as defined in claim 7, wherein said means operable to secure said elongate rod member in said deformed displaced position comprises gripper means operable to grip said free end portion of said elongate rod member.

9. A loom as defined in claim 7, wherein said weft thread introducing means comprises a respective weft thread introducing member corresponding with each said nap fabric strip to introduce a respective weft thread into each first shed.

10. A loom as defined in claim 7, wherein said elongate flexible rod member is in permanent operative connection with said drive means.

11. A loom as defined in claim 10, wherein said elongate rod member is positively coupled to said drive means.

12. A loom as defined in claim 7, comprising a plurality of said elongate rod means each connected to a respective drive member.

* * * * *